US005622753A

United States Patent [19]

Shepley et al.

[11] Patent Number: 5,622,753

[45] Date of Patent: Apr. 22, 1997

[54] METHOD OF PREPARING AND COATING ALUMINUM BORE SURFACES

[75] Inventors: Barry E. Shepley, Novi; Christopher K. Palazzolo, Ann Arbor; Robert E. DeJack, Whitmore Lake; John E. Chancey, Grosse Pointe Farms; Deborah R. Pank, Ypsilanti, all of Mich.

[73] Assignee: Ford Motor Company, Dearborn, Mich.

[21] Appl. No.: 630,106

[22] Filed: Apr. 8, 1996

[51] Int. Cl.[6] ..... C23C 4/10; B05D 7/22

[52] U.S. Cl. ..... 427/453; 427/456; 427/222; 427/239; 427/292; 427/422; 427/427

[58] Field of Search ..... 427/292, 239, 427/233, 456, 453, 422, 427

[56] References Cited

U.S. PATENT DOCUMENTS 2,149,826 2/1937 Albertson et al. .

5,185,183 2/1993 Gonda et al. ..... 427/239

*Primary Examiner*—Janyce Bell

*Attorney, Agent, or Firm*—Joseph W. Malleck

[57] ABSTRACT

A method of preparing and coating cylindrical bore surfaces of an aluminum workpiece that comprises (a) inserting and rotationally reciprocally moving a plurality of honing elements against the bore surface with a pressure of at least 30 psi to effect a pattern of spiral overlapping abrasions on said surface, each element being constituted of multifaceted, irregular-shaped, abrasive particles (i.e., diamond or SiC) having a particle size of 30–1300 micrometers. The particles, when in contact with the surface, plow micro-sized, non-smooth and irregularly spaced grooves in the aluminum workpiece resulting in spiral peaks and valleys along the direction of movement of the particles, whereupon repeated reciprocation and rotation of the elements (i.e. 50–200 sfm) thereagainst results in overlapping grooves and cross-abrading of the prior peaks and valleys accompanied by a molding and folding over of certain of the peaks and valleys to create irregular, micro-sized tears, folds, and undercuts; and (b) thermally depositing wear resistant metallic particles onto the abraded surface to form a cohesive coating, said deposited particles migrating into the non-smooth grooves and into the irregular tears, folds, and undercuts during thermal deposition to increase the mechanical bond strength of the coating to the workpiece surface.

10 Claims, 4 Drawing Sheets

METHOD OF PREPARING AND COATING ALUMINUM BORE SURFACES

BACKGROUND OF THE INVENTION

1. Technical Field

This invention relates to the technological art of mechanically finishing metal surfaces and to the art of thermally depositing metals onto substrates, and more particularly to performing such technological arts with an aluminum substrate such as an aluminum engine block.

2. Discussion of the Prior Art

The standard surface preparation process used in the thermal spray industry is that of grit blasting metal substrates employing a media, such as silica, sand, alumina, chilled iron or garnet, to produce a roughened surface topography characterized by a dimpled or hammered effect, usually free of oxides. Typically about 0.1 lb. per minute of grit is propelled through a nozzle at inlet pressures of as high as 1.8 ksi. in a gas ($N_2$ or air) medium. Outlet velocities may be supersonic and the volume of material removed will vary as particle velocity is raised. The blasted surface must then be cleaned to remove any foreign contaminants or residual grit or oxides. In spite of such cleaning, there is always the problem of grit or oxide entrapment in the prepared surface and grit contamination of the part and surrounding machinery as a result of such blasting. Grit blasting can be damaging to the final product and to the manufacturing process equipment resulting in increased maintenance costs and reduced productivity; on-line collection, containment and disposition of a grit media is a difficult and environmentally unfriendly process.

Sometimes rough threading, by a single point machining tool, is utilized to create a roughened surface; often, this rough threading is combined with grit blasting to achieve the final roughened surface. The problem with rough threading, as a surface preparation for thermal spray, is that it does not provide an adequate level of bond strength. Rough threading produces non-intersectingintersecting grooves and each groove is smooth and shallow, resulting from the use of a fixed cutting tool having a semi-circular cutting tip or radius. The grooves are regularly spaced, which inhibits bond strength of a coating applied thereto.

Aluminum substrates, particularly those to be used in very severe operating conditions, such as experienced in a cylinder chamber of a internal combustion engine, present a more challenging problem for adhesion of the coating to the prepared surface. The tenacious formation of aluminum oxide on any exposed aluminum surface may inhibit chemical or mechanical bonding of the superimposed metallic coating irrespective of the type of thermal spraying employed.

It is, accordingly, an object of this invention to provide an enhanced mechanical/chemical bond between a thermally sprayed metallic coating and an aluminum substrate without the disadvantage of high cost of surface preparation or the disadvantages of grit contamination, oxide residual, and grit disposal associated with prior art technologies.

SUMMARY OF THE INVENTION

The invention herein that meets such object is a method of preparing and coating cylindrical bore surfaces of an aluminum workpiece that comprises (a) inserting and rotationally reciprocally moving a plurality of honing elements against the bore surface with a pressure of at least 30 psi to effect a pattern of spiral overlapping abrasions on the surface, each element being constituted of multifaceted, irregular-shaped, abrasive particles, the particles, when in contact with the surface, plowing micro-sized, non-smooth and irregularly-shaped grooves in the aluminum workpiece, resulting in spiral peaks and valleys along the direction of movement of the particles, whereupon repeated reciprocation and rotation of the elements thereagainst results in overlapping grooves and cross-abrading of the prior peaks and valleys accompanied by a molding and folding over of certain of the peaks and valleys to create irregular micro-sized tears, folds, and undercuts; and (b) thermally depositing wear resistant metallic particles onto the abraded surface to form a cohesive coating, said deposited particles migrating into the irregular tears, folds, and undercuts during thermal deposition to increase the mechanical bond strength of the coating to the workpiece surface.

Preferably the aluminum workpiece is comprised of a 319 aluminum alloy; the abrasive particles are preferably comprised of diamond or silicon carbide controlled to the size range of 30–400 grit US mesh (30–1300 micrometers); the rate of movement of the elements is preferably about 50–200 surface feet per minute; and a light pressure of contact between the elements and workpiece is assured by floating the stones thereagainst with continuous contact.

DETAILED DESCRIPTION AND BEST MODE

Figure 1:
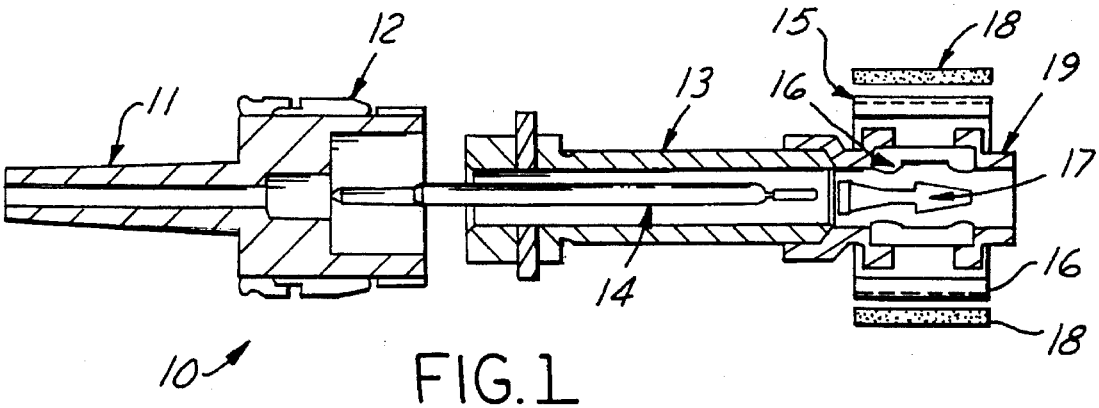
FIG. 1 is an exploded elevational view of an expandable honing tool useful for honing the internal diameter of cylinder bores in accordance with this invention.
Figure 1A:
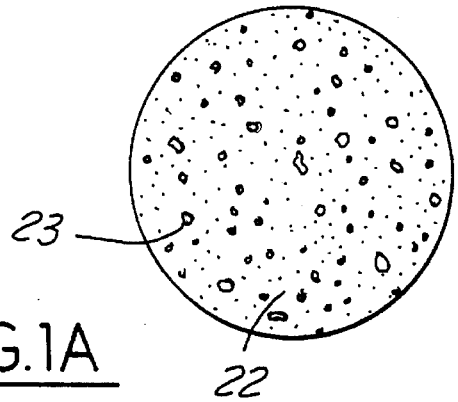
FIG. 1A is a highly enlarged view off a portion of the surface of the honing stones of FIG. 1, illustrating the mixture of resin and abrasive particles.
Figure 2:
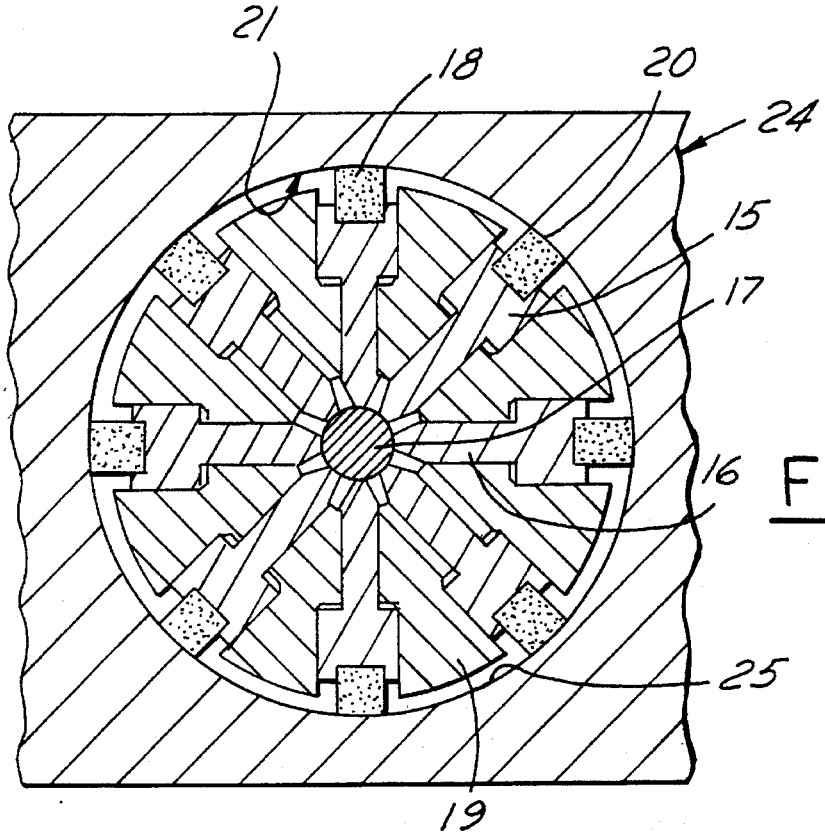
FIG. 2 is an enlarged cross-sectional view of the head of the tool of FIG. 1.

The expandable honing tool 10 utilized in conjunction with this invention comprises a driver 11 having an adjustable head 12 within which is received a removable quill shaft 13 carrying a cone rod 14 that extends through both shafts 12 and 13; axial movement of the cone rod 14 is effective to radically expand a plurality of holders 15, held by expanders 16 in slots of a body 19, by actuations from a tapered arbor or cone 17. Each holder carries an abrasive honing stone 18. In the illustration of FIG. 2, as many as 8 honing stones 18 are employed each having an outer surface 20 with a radius complementary to the internal radius of the cylinder bore 21 of the aluminum engine block 24 that is being honed. The aluminum surface 25 of the engine block to be honed is preferably comprised of an aluminum alloy such as 319.

The material of the stones 18 is preferably comprised of a powder metal bond 22 containing abrasive particles 23 of a size randomly ranging from 37–1270 micrometers. The abrasive particles 23 preferably consist of diamond, but can be any hard material such as silicon carbide, aluminum oxide, boron nitride, etc., which is effective in abrading an aluminum surface. Diamond is harder and longer lasting with sharp edges, while silicon carbide is a better conductor of heat than aluminum oxide and fractures more easily, providing new cutting surfaces that extend the useful life of the abrasive. These materials are particularly useful in polishing low strength metal such as aluminum. The diamond particles are contained in the powder metal bond which has a low wear rate commensurate with diamond. SiC particles are contained in a phenolic resin matrix in a similar manner to present a number of random multipoint edges. Such particles (diamond or SiC) present irregular-shaped, multi-faceted, abrasive cutting edges. The stone or hone is in reality a composite controlled as to particle size and structure with randomness being important for successful use.

The honing tool 10 is inserted and rotationally and reciprocally moved to carry a plurality of such honing stones against the bore surface 25 with a pressure of 30–150 psi. Enough pressure must be used to cut aluminum, which has generally been found to be 30 psi.

Figure 3:
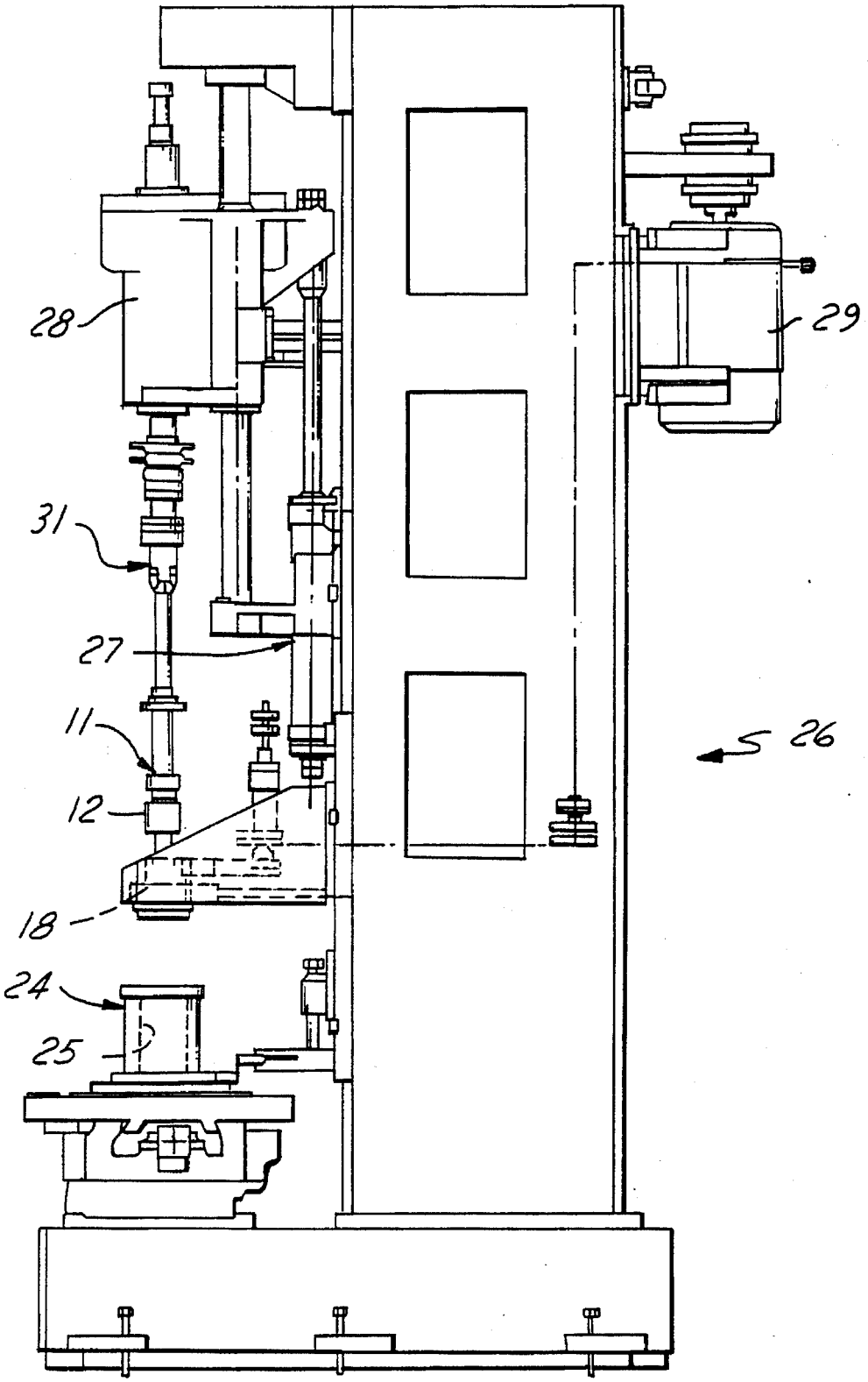
FIG. 3 is an elevational view of a vertical honing machine carrying the honing tool for insertion into an aluminum workpiece (an engine block having a plurality of cylindrical bores)
Figure 4:
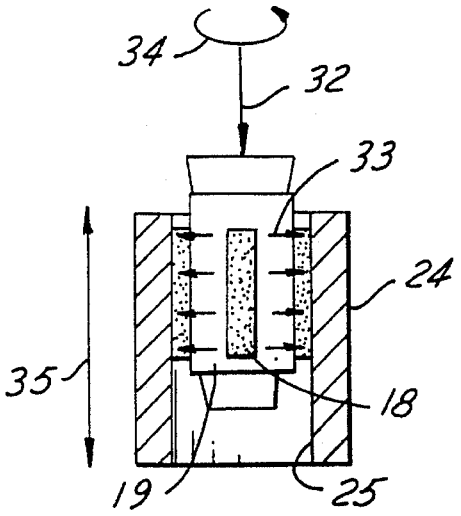
FIG. 4 is a schematic illustration of how the stones are brought into bearing contact with the internal diameter of the cylindrical bore surface.

This may be carried out by a typical industrial honing machine 26, such as shown in FIG. 3, wherein the tool 10 is pneumatically lowered and raised by means 27 along a path for reciprocation; a rotational drive unit 28 provided by an electric motor 29, rotates the shaft assembly 30 which has u-joints 31 to allow the tool to float with light pressure against the bore surface 25 to maintain concentricity about the bore axis. As shown in FIG. 4, the force or pressure 32 of the expanding arbor or mandrel brings the stones 18 in contact with surface 25 of block 24, with a surface pressure 33. Each contact area or particle size of the stones undergoes both rotation 34 and reciprocation along stroke path 35.

Figure 5:
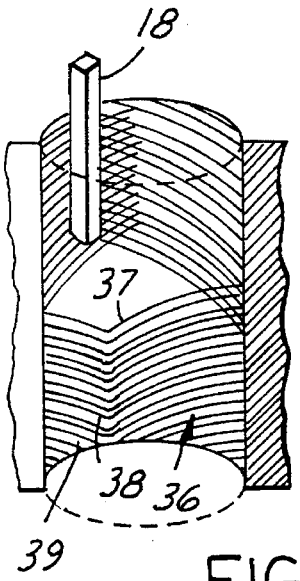
FIG. 5 is an isometric view of the internal surface of a cylinder bore being worked upon by a honing stone according to this invention.
Figure 6:
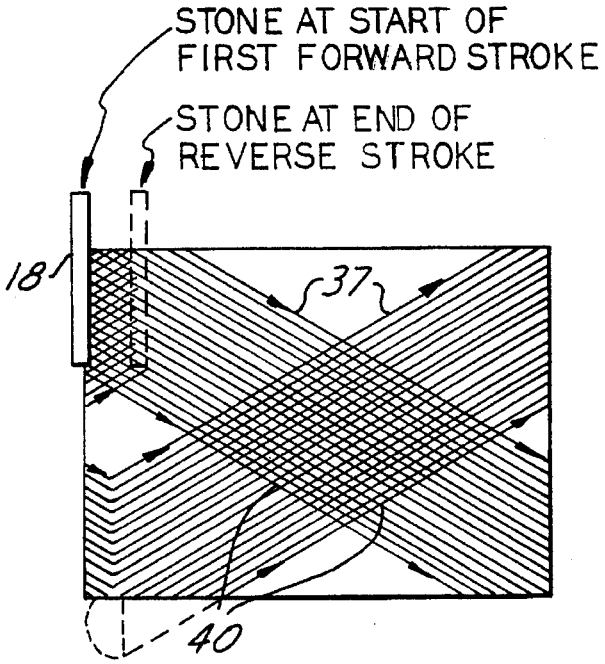
FIG. 6 is a view of the unscrolled pattern of abrasions resulting from the rotation and reciprocation of honing stones employed by this invention.
Figure 7:
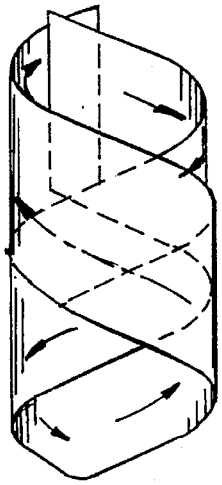
FIG. 7 is an isometric view of the abrasive path of the stone contact.
Figure 8:
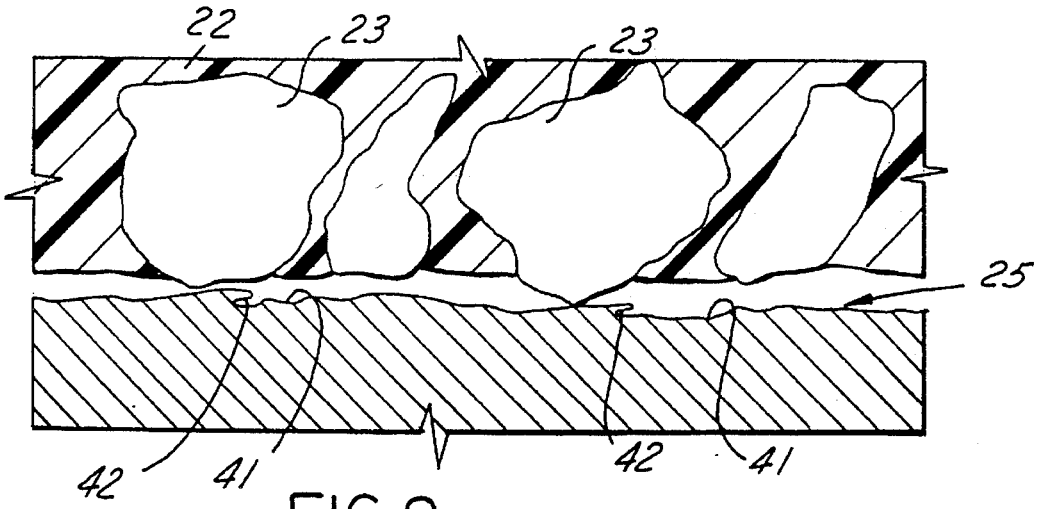
FIG. 8 is an extremely enlarged schematic illustration of adjacent particles of a honing stone effecting molding and folding over of peaks and ridges of previous abrasions to achieve a texture of undercuts.

The stones effect a pattern of spiral overlapping abrasions or scratches 36 on the surface 25 as shown in FIG. 5. The particles 33, when in contact with the surface, plow micro-sized, non-smooth and irregular-shaped grooves 36 in the aluminum surface which result in spiral peaks 38 and valleys 39 along the direction 37 of movement of the particles. Upon repeated reciprocation and rotation (see FIG. 7), there will be overlapping grooves 36 and cross-abrading of the prior peaks and valleys at intersections 40 (see FIG. 6) which is then accompanied by a molding and folding over of certain of the prior peaks and valleys to create irregular micro-sized tears or folds 41 and undercuts 42 (see FIG. 8). The abrasive particles are random in grit size (30–400 US mesh) to effect the irregular spacing of the grooves or scratches 36, and the abrasive particles are jagged at the point of contact with the surface 25 to effect non-smooth side walls or valley for such grooves 36.

The stones are preferably moved at a surface speed of about 50–200 sfm., the rate of plowing of material is usually about 0.0075 in.$^3$/in./min., with the number of grains concentrated in the stone being about 35–50 carat weight for diamond. The resulting surface or roughened finish of the aluminum surface will be in the range of about 0.5–17 micrometers. As particularly shown in FIG. 6, the cross-abrasion of previously plowed abrasions results in intersections 40 that mold and fold over previous ridges to create tears and undercuts 42.

Figure 10:
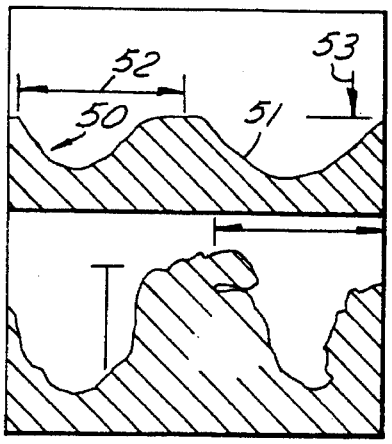
FIG. 10 is a schematic cross-sectional comparison view of both a rough threaded surface and of a surface roughened by this invention.

The cutting edge used with prior art rough threading is smooth and rounded (radius being a regular semi-circle) thereby producing relatively shallow groove 50 (as shown in FIG. 10) with smooth surfaces in the bottom of each valley 51. The grooves 50 are uniformly spaced at 52 and have a uniform depth 53 resulting from the single fixed relation to the workpiece. There is no overlapping pattern of grooves nor intersection of peaks and valleys because it is a one pass operation. In contradistinction, the invention herein uses irregularly-shaped, abrasive particles which, because of their irregular shape and random contact edges or points, produce irregular or non-smooth grooves 54 or scratches that can be deeper and possess a random spacing 55 and a depth 56. The particles of the abrasive stone protrude outwardly by varying degrees from the stone and effect random overlapping and intersections of the peaks and valleys that push, fold, and tear prior created peaks and valleys. This tearing and folding creates undercuts 56 or vacant areas partially covered with aluminum. The molten spray can flow under and lock into such folded metal.

Figure 9:
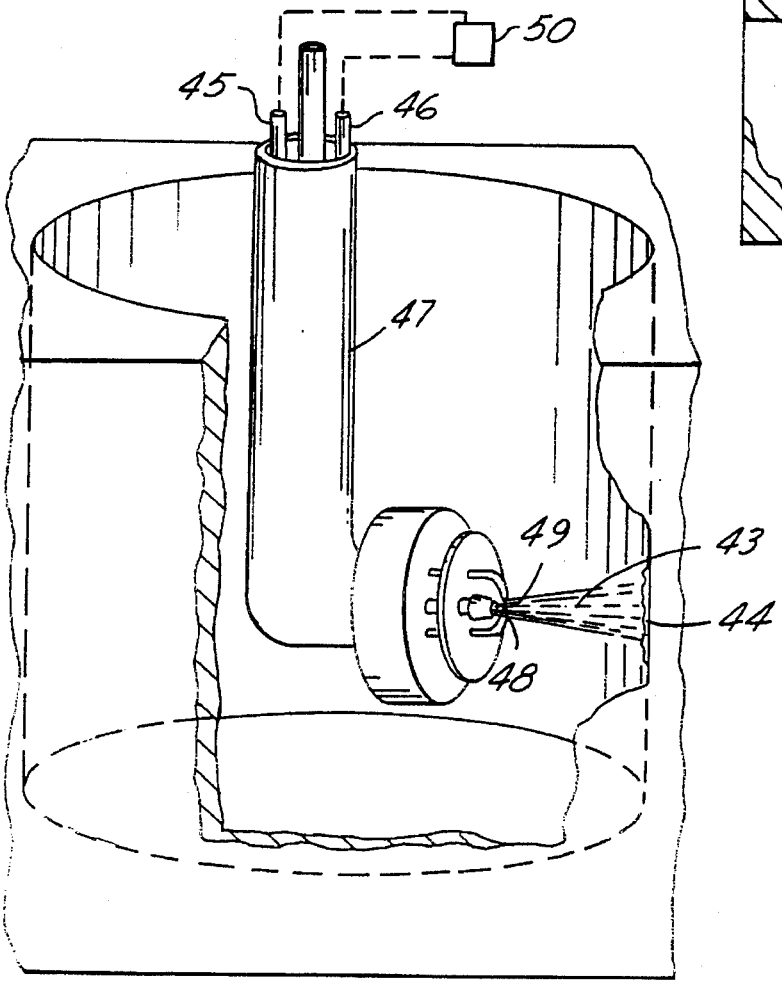
FIG. 9 is a schematic elevational sectional view of a thermal spray wire arc gun utilized to deposit a metallic coating on a honed surface of a cylinder bore in accordance with this invention.

With surface 25 topographically roughened, thermal deposition of wear resistant metallic particles 43 onto the abraded surface is carried out to form a cohesive coating 44 thereon (see FIG. 9). The deposited melted particles migrate into the irregular texture and undercuts 42 or 56 during thermal deposition as a result of the force of impact as well as the semi-fluid character of the particles upon contact with the aluminum surface. The migration into the undercuts and irregular texture increases the mechanical bond strength of the coating to the workpiece surface to a level of about 3000–4000 psi.

Thermal spraying may be carried out with an apparatus such as shown in FIG. 9 wherein 2 wires 45, 46 are fed down a rotatable and reciprocating journal shaft and directed to have their tips 48 closely spaced to permit creating an arc through which a gas passes. Electrical current from a power source 50 is passed through the wires so as to create the arc across the gap 49 while pressurized gas is directed through the gap to spray molten droplets from the wires; the droplets are then projected (43) as a result of the gas onto the sprayed target area which is a region of the internal bore surface. This process differs from other thermal spray processes in that there is no external heat source such as a gas flame or electrically induced plasma. The heating and melting occurs when the two electrically opposed charged wires, comprising the spray material, are fed together in such a manner that a controlled arc occurs at the intersection; the molten metal droplets from the wire tips are atomized and propelled onto the prepared roughened substrate. The droplets are propelled with velocity usually of about 50–200 feet/minutes, and the deposition rates of the metal droplets can be up to 120 lbs./hour. The metallic character of the wire may be a variety of materials, but preferably is a low alloy steel wire such as 1010 low carbon steel. Initial spray coatings using nickel aluminide, silicon bronze, or other iron base materials, may also be used prior to spraying a top coat of steel. Secondary air or control of primary air may be used to effect formation of a small amount of solid lubricant in the form of $FeO_x$ when spraying steel.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of preparing and coating an internal cylindrical bore surface of an aluminum workpiece comprising:

(a) inserting and rotatably reciprocally moving a plurality of honing elements against said bore surface with a pressure of at least 30 psi to effect a pattern of spiral overlapping abrasions on said surface, each element being constituted of multifaceted, irregular-shaped, abrasive particles, said particles, when in contact with said surface, plowing micro-sized, non-smooth and irregularly-spaced grooves in said aluminum workpiece, resulting in spiral peaks and valleys along the direction of movement of the particles, whereupon repeated reciprocation and rotation of the elements thereagainst results in overlapping grooves and cross-abrading of the prior peaks and valleys accompanied by a molding and folding over of certain said peaks and valleys to create irregular micro-sized tears, folds, and undercuts; and (b) thermally spraying wear resistant metallic particles onto said abraded surface to form a cohesive coating, said deposited particles migrating into said non-smooth grooves and into said irregular tears, folds and undercuts during thermal deposition to increase the mechanical bond strength of said coating to said workpiece surface.

2. The method as in claim 1, in which said abrasive particles are random in grit size to effect said irregular spacing of grooves.

3. The method as in claim 1, in which said abrasive particles are jagged at the point of contact with said surface to effect said non-smooth groove.

4. The method as in claim 1, in which said abrasive particles are comprised of one of diamond, silicon carbide, and $Al_2O_3$.

5. The method as in claim 1, in which honing elements are honing stones constituted of powder metal bonded multifaceted abrasive particles.

6. The method as in claim 1, in which said abrasive particles have a size in the range of 30–1300 micrometers.

7. The method as in claim 1, in which said thermal spraying is carried out with two consumable electrode wires and the resulting bond strength of the coating to the roughened surface is in range of 3000–4500 psi.

8. The method as in claim 1, in which the average surface roughness effected by step (a) is in the range of 0.5–17 micrometers.

9. The method as in claim 1, in which the metallic particles deposited in step (b) are comprised of low alloy steel with the thermal spraying technique introducing a controlled amount of air or oxygen to effect a deposit of a predetermined amount of FeO in the coating.

10. The method as in claim 1, in which of said abrasive elements are moved at a speed of about 50–200 sfm to effect a roughened topography of about 10 micrometers.

* * * * *